US006513566B2

(12) United States Patent
Larin

(10) Patent No.: US 6,513,566 B2
(45) Date of Patent: Feb. 4, 2003

(54) BALCONY SHIELDING DEVICE

(75) Inventor: Normand Larin, Montréal-Nord (CA)

(73) Assignee: Inventions N.L. Inc., Montreal-Nord (CA)

( * ) Notice: Subject to any disclaimer, the term of this patent is extended or adjusted under 35 U.S.C. 154(b) by 0 days.

(21) Appl. No.: 09/799,507

(22) Filed: Mar. 7, 2001

(65) Prior Publication Data

US 2001/0022217 A1 Sep. 20, 2001

(30) Foreign Application Priority Data

Mar. 10, 2000 (GB) ..... 0005651

(51) Int. Cl.[7] ..... A47G 5/00

(52) U.S. Cl. ..... 160/351; 160/265; 182/178.3; 182/129; 256/24; 52/638

(58) Field of Search ..... 160/351; 182/178.1, 182/178.3, 179.1; 52/637, 638; 403/49; 256/24, 27

(56) References Cited

U.S. PATENT DOCUMENTS

| | | | | | |
|---|---|---|---|---|---|
| 3,807,884 | A | * | 4/1974 | Juculano | 403/49 |
| 3,850,264 | A | * | 11/1974 | Salinas | 182/178.3 |
| 4,691,484 | A | * | 9/1987 | Wilson | 52/79.6 |
| 4,760,660 | A | * | 8/1988 | Fast | 40/308 |
| 4,823,529 | A | * | 4/1989 | Canfield et al. | 52/263 |
| 4,889,057 | A | * | 12/1989 | Chartrand | 108/42 |
| 4,937,988 | A | * | 7/1990 | Gratton | 52/101 |
| 5,038,889 | A | * | 8/1991 | Jankowski | 182/129 |
| 5,054,580 | A | * | 10/1991 | Cheek | 182/179.1 |
| 5,556,080 | A | * | 9/1996 | Vise | 256/24 |
| 5,575,938 | A | * | 11/1996 | Ono | 249/189 |
| 5,613,543 | A | * | 3/1997 | Walton | 160/265 |
| 5,728,047 | A | * | 3/1998 | Edoga | 600/227 |
| 5,865,270 | A | * | 2/1999 | Strength et al. | 182/186.6 |
| 5,884,725 | A | * | 3/1999 | Reyland | 182/82 |
| 5,906,069 | A | * | 5/1999 | Berliner | 160/351 X |
| 6,003,631 | A | * | 12/1999 | Knauth | 182/82 |
| 6,405,830 | B1 | * | 6/2002 | Hayman | 182/113 |

FOREIGN PATENT DOCUMENTS

| | | | | |
|---|---|---|---|---|
| FR | 2725744 | * | 4/1996 | E04F/11/18 |

* cited by examiner

*Primary Examiner*—Bruce A. Lev

(57) ABSTRACT

A balcony and a shield including first and second shielding sections. The sections define corresponding first and second shielding screens. The shield includes a mounting rod defining a rod attachment section and a rod spacing section. The rod attachment section is sized so as to extend from the footrail to the handrail of the balcony banister. The rod spacing section extends from the rod attachment section and is adapted to extend upwardly away from the handrail. A securement component secures the rod attachment section to both the handrail and the footrail. A linking component securely links the first shielding section to the rod spacing section above the second shielding section.

20 Claims, 5 Drawing Sheets

Fig. 9
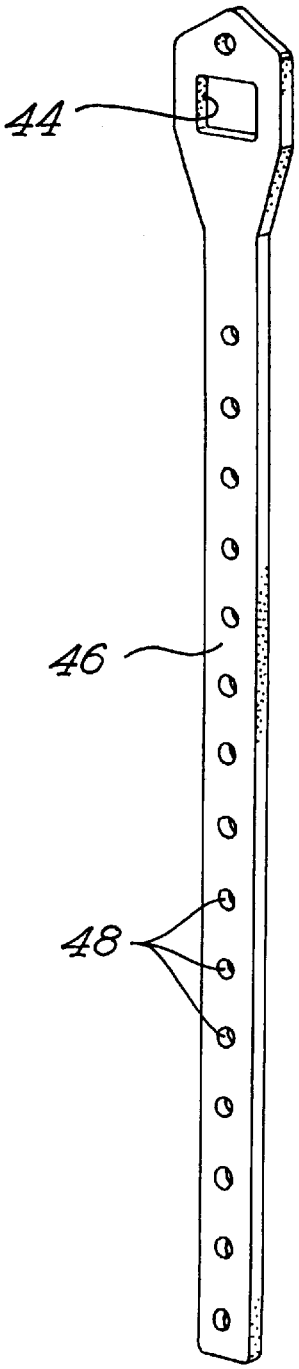
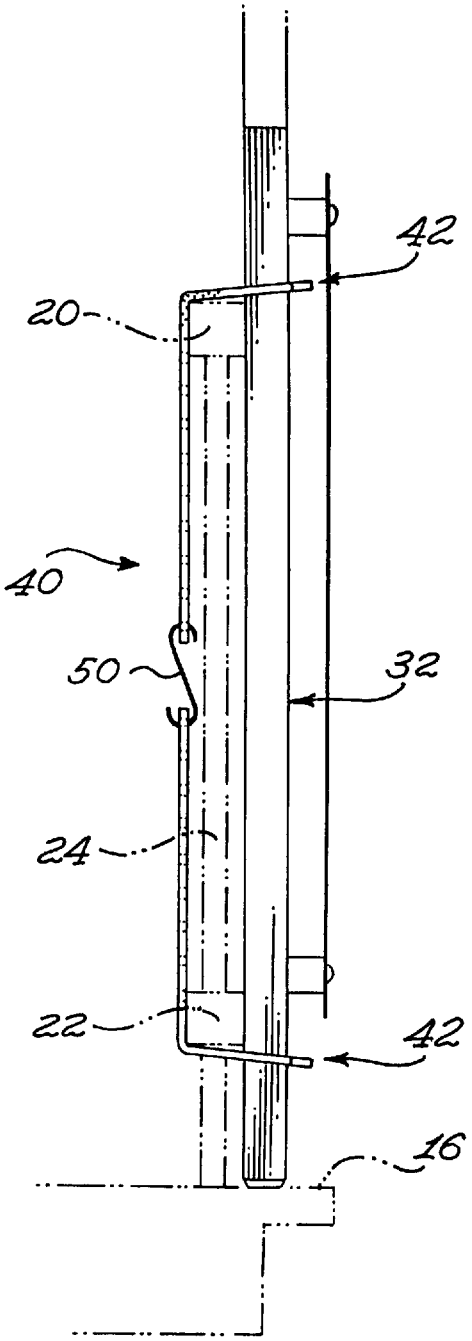
Fig. 10

BALCONY SHIELDING DEVICE

FIELD OF THE INVENTION

The present invention relates to the general field of balcony accessories and is particularly concerned with a balcony shielding device.

BACKGROUND OF THE INVENTION

Many dwellings include balconies, patios, terraces or the like. With the relatively recent trends towards "cocooning" there has been a concomitant recent tendency to use such spaces more frequently for various activities, including social activities and sun bathing. During such activities, it is often desirable to provide some king of sun screening structure.

Indeed, there is a relatively recent increase awareness to the fact that over-exposure to the suns' rays may prove to be unhealthy and detrimental.

Furthermore, the suns' rays may become obnoxious for various activities when particularly intense.

The prior art has shown various examples of structures such as sun umbrellas designed so as to be affixed to various components of the balcony or adjacent building structure.

However, such prior art structures have proven to be unsatisfactory for various reasons. For example, prior art balcony sun umbrellas are often provided with inadequate fixing means and are thus susceptible of being blown away by the sometimes gusting winds created adjacent buildings. The sun umbrellas being blown away create a potential serious health hazards for individuals located underneath the balcony. Also, some prior art sun umbrellas have proven to be unaesthetical and offer limited adjustment characteristics.

Still further, most prior art balcony umbrellas suffer from providing limited privacy to individuals located on the balcony. This limitation has proven to be particularly annoying in urban and suburban areas particularly those having blocks of high density housing. In such settings, it is often desirable to make it difficult for ones neighbor to be able to look upon a balcony or a terrace. Various makeshift solutions have been proposed in the prior art in a attempt to solve this particular problem. For example, some balcony owners have resorted to using plants or curtains suspended from the balcony located above.

However, these solutions have proven to be unsatisfactory for various reasons including lack of adequate structure support, lack of adjustability and the like. Other prior art structures typically attached to the adjacent building or to the balcony located above have also been proposed. Most of these structures, however, require the use of an adjacent structure for purpose of solidly anchoring the shading structure.

Furthermore, the prior art structure often do not provide adequate shielding from adjacent neighbors that often can still look through the banister of the balcony.

This has proven to be particularly annoying for owners of balconies having a banister that includes a footrail and a handrail separated by balusters. Since this type of balcony is particularly popular, most prior art structure simply do not provide efficient shielding. Accordingly, there exists a need for an improved balcony shielding device.

Advantages of the present invention include that the proposed balcony shielding device is specifically designed so as to be solidly anchored to the balcony banister thus eliminating the need for other adjacent support structures.

Also, the proposed balcony shielding device is provided with sturdy securement means allowing the device to be safely attached to the balcony banister reducing the risk of having the device blown away or otherwise fall from the balcony.

Still further, the proposed balcony shielding device allows for attachment to both the handrail and the footrail of conventional balcony banisters thus further increasing the safety of the anchorage components.

Also, the proposed balcony shielding device is provided with features allowing the device to be securely anchored to various types of banisters including banisters with relatively rectilinear balusters and banisters having relatively convex ornamental balusters.

Still further, the proposed balcony shielding device is specifically designed with means for providing selective and adjustable shielding of both the area located in front of the banisters and above the banisters. The balcony shielding device is provided with means for adjusting the angle and height of the shielding component located above the banister.

The proposed balcony shielding device is specifically designed so as to be manufacturable using conventional forms of manufacturing so as to provide a balcony shielding device that will be economically feasible, long lasting and relatively trouble free in operation.

The proposed balcony device is specifically designed so as to anchorable to a conventional balcony banister through a set of ergonomical steps without requiring special tooling or manual dexterity. The proposed balcony shielding device is specifically designed so as to be able to withstand harsh environmental elements.

SUMMARY OF THE INVENTION

In accordance with an embodiment of the invention, there is provided a device for shielding a balcony, the balcony including a balcony floor and a banister attached to the balcony floor, the banister including a handrail, a foot rail and at least one baluster extending between the handrail and the footrail, the device comprising: a first shielding section, the first shielding section including a first shielding screen; a mounting means for mounting the device to the balcony, the mounting means including a mounting rod, the mounting rod defining a rod attachment section and a rod spacing section, the rod attachment section being sized so as to extend at least from the footrail to the handrail, the rod spacing section extending from the rod attachment section and being adapted to extend upwardly away from the handrail; a securement means for securing the rod attachment section to both the handrail and the footrail; a linking means for securely linking the first shielding section to the rod spacing section; whereby when the rod attachment section is attached to both the handrail and the footrail, the first shielding section is securely attached to the balcony above the banister.

In one embodiment of the invention, the securement means includes a securement strap, the securement strap defining a pair of opposed strap longitudinal ends; the securement strap being provided with a strap-to-rod attachment means positioned adjacent each of the strap longitudinal ends for attaching the strap longitudinal ends to the rod attachment section; the securement strap being also provided with a strap length adjustment means positioned intermediate the strap longitudinal ends for allowing customization of the length of the strap; the securement strap being configured and sized so that when the rod attachment section abuttingly contacts both the handrail and the footrail, the securement strap can be tightly wrapped around the banister with one of the strap-to-rod attachment means attached to the rod attachment section adjacent the handrail and the other strap-to-rod attachment means attached to the rod attachment section adjacent the footrail.

Preferably, at least one of the strap-to-rod attachment means includes a rod receiving aperture extending through the securement strap adjacent a corresponding strap longitudinal end, the rod receiving aperture being configured and sized so as to substantially fittingly and slidably receive at least a section of the rod attachment section.

Conveniently, the securement strap defines two strap segments, each of the strap segments having segment apertures positioned longitudinally therealong, the strap length adjustment means including a hook component selectively attached to one of the segment apertures of both the strap segments.

In another embodiment of the invention, the securement means includes a pair of balcony-to-mounting rod securement component, each of the balcony-to-mounting rod securement components including a generally elongated securement component spacing segment, the securement component spacing segment defining a spacing segment first longitudinal end and a spacing segment second longitudinal end; a segment-to-rod attachment means for attaching the securement component spacing segment adjacent the spacing segment first longitudinal end to the rod attachment section so that the securement component spacing segment extends away from the rod attachment section; a segment-to-balcony attachment means for attaching the securement component spacing segment adjacent the spacing segment second longitudinal end to the balcony so that the securement component spacing segment extends away from the balcony; whereby when one of the segment-to-balcony attachment means is attached to the handrail and the other segment-to-balcony attachment means is attached to the footrail the rod attachment section is secured to the banister in a spaced relationship relative to the latter.

Preferably, the segment-to-rod attachment means includes an attachment sleeve defining a sleeve peripheral wall, the attachment sleeve being configured and sized for substantially fittingly and slidably receiving at least a section of the rod attachment section; the attachment sleeve being provided with a bolt recess extending through the sleeve peripheral wall; the segment-to-rod attachment means also including a locking bolt threadably inserted in the bolt recess, the locking bolt defining a bolt tip for abuttingly and frictionally contacting the rod attachment section when the rod attachment section is inserted into the sleeve.

Conveniently, the segment-to-balcony attachment means includes a generally "L"-shaped attachment bracket attached to the securement component spacing segment adjacent the spacing segment second longitudinal end, the attachment bracket defining a bracket first segment extending in a generally parallel relationship with the securement component spacing segment and a bracket second segment extending from a distal end of the bracket first segment in a generally perpendicular relationship relative to the bracket first segment, the bracket first and second segments together defining a generally "L"-shaped bracket inner surface; a biasing means for biasing a segment of the banister against the bracket inner surface whereby the biasing means is adapted to be used for releasably locking a segment of either the handrail or the footrail in abutting contact against the bracket inner surface.

Preferably, the biasing means includes a bracket strap, the bracket strap defining a bracket strap first longitudinal end and a bracket strap second longitudinal end, the bracket strap first longitudinal end being attached to the securement component spacing section adjacent the spacing segment second longitudinal end, the bracket strap second longitudinal end being provided with a strap-to-bracket attachment means for attaching the bracket strap adjacent the bracket strap second longitudinal end to the bracket first segment; whereby the strap is configured and sized so as to be wrapped around both the attachment bracket and either a segment of either the handrail or the footrail abutting against the bracket inner surface for releasably locking a segment of either the handrail or the footrail in abutting contact against the bracket inner surface.

Conveniently, the linking means allows the first shield section to pivot relative to the mounting rod about a first shield section pivot axis between a first screen position wherein the first shielding screen is in a generally parallel relationship relative to the rod spacing section and a second screen position wherein the first shield screen is in an angled relationship relative to the rod spacing section.

Preferably, the linking means includes a linking plate, the linking plate having a generally elongated configuration defining a linking plate first longitudinal end and a linking plate second longitudinal end; the linking plate being pivotally attached to the rod spacing section adjacent the plate first longitudinal end; the linking means also including an angular locking means for locking the linking plate in a predetermined angular relationship relative to the rod spacing section.

Conveniently, the linking means is provided with a shield height adjustment means for allowing the customization of the distance between the first shielding section and the rod attachment section.

Preferably, the first shielding screen is mounted on a first screen frame, the first screen frame including at least one elongated frame member, the shield height adjustment means including a frame mounting sleeve, the frame mounting sleeve being attached to the rod spacing section, the frame mounting sleeve being configured and sized for slidably and substantially fittingly receiving the at least one elongated frame member, the frame mounting sleeve being provided with a frame sleeve releasable locking means for selectively allowing and preventing the at least one elongated frame member to slide within the frame mounting sleeve.

Conveniently, the linking means allows the first shield section to pivot relative to the mounting rod about a first shield section pivot axis between a first screen position wherein the first shielding screen is in a generally parallel relationship relative to the rod spacing section and a second screen position wherein the second shield screen is in an angled relationship relative to the rod spacing section, the linking means being also provided with a shield height adjustment means for allowing the customization of the distance between the first shielding section and the rod attachment section.

Preferably, the linking means includes a linking plate, the linking plate having a generally elongated configuration defining a linking plate first longitudinal end and a linking plate second longitudinal end; the linking plate being pivotally attached to the rod spacing section adjacent the plate first longitudinal end; the linking means also including an angular locking means for locking the linking plate in a predetermined angular relationship relative to the rod spacing section; the first shielding screen is mounted on a first screen frame, the first screen frame including at least one elongated frame member, the shield height adjustment means including a frame mounting sleeve, the frame mounting sleeve being attached to the linking plate adjacent the linking plate second longitudinal end, the frame mounting sleeve being configured and sized for slidably and substantially fittingly receiving the at least one elongated frame member, the frame mounting sleeve being provided with a frame sleeve releasable locking means for selectively allowing and preventing the at least one elongated frame member to slide within the frame mounting sleeve. Preferably, the rod spacing section is releasably attached to the rod mounting section.

Conveniently, the device further comprises a second shielding section, the second shielding section including a second shielding screen, the second shielding section being attached to the mounting rod so as to shield the banister.

In accordance with the present invention, there is also provided a device for shielding a balcony, the balcony including a balcony floor and a banister attached to the balcony floor, the banister including a handrail, a foot rail and at least one baluster extending between the handrail and the footrail, the device comprising: a first shielding section, the first shielding section including a first shielding screen; a second shielding section, the second shielding section including a second shielding screen; a second section securement means for securing the second shielding section to the banister so that the second shielding screen shields the banister; a first section securement means for securing the first shielding section to the second shielding section so that when the second shielding screen shields the banister the first shielding screen is positioned above the banister.

Preferably, the second section securement means includes a securement strap, the securement strap defining a pair of opposed strap longitudinal ends; the securement strap being provided with a strap-to-rod attachment means positioned adjacent each of the strap longitudinal ends for attaching the strap longitudinal ends to the rod attachment section; the securement strap being also provided with a strap length adjustment means positioned intermediate the strap longitudinal ends for allowing customization of the length of the strap; the securement strap being configured and sized so that when the rod attachment section abuttingly contacts both the handrail and the footrail, the securement strap can be tightly wrapped around the banister with one of the strap-to-rod attachment means attached to the rod attachment section adjacent the handrail and the other strap-to-rod attachment means attached to the rod attachment section adjacent the footrail.

Conveniently, the second section securement means includes a pair of balcony-to-mounting rod securement component, each of the balcony-to-mounting rod securement components including a generally elongated securement component spacing segment, the securement component spacing segment defining a spacing segment first longitudinal end and a spacing segment second longitudinal end; a segment-to-rod attachment means for attaching the securement component spacing segment adjacent the spacing segment first longitudinal end to the rod attachment section so that the securement component spacing segment extends away from the rod attachment section; a segment-to-balcony attachment means for attaching the securement component spacing segment adjacent the spacing segment second longitudinal end to the balcony so that the securement component spacing segment extends away from the balcony; whereby when one of the segment-to-balcony attachment means is attached to the handrail and the other segment-to-balcony attachment means is attached to the footrail the rod attachment section is secured to the banister in a spaced relationship relative to the latter.

Preferably, the linking means allows the first shield section to pivot relative to the mounting rod about a first shield section pivot axis between a first screen position wherein the first shielding screen is in a generally parallel relationship relative to the rod spacing section and a second screen position wherein the second shield screen is in an angled relationship relative to the rod spacing section, the linking means being also provided with a shield height adjustment means for allowing the customization of the distance between the first shielding section and the rod attachment section.

BRIEF DESCRIPTION OF THE DRAWINGS

An embodiment of the present invention will now be disclosed, by way of example, in reference to the following drawings in which:

FIG. 9: in a perspective view, illustrates a securement strap adapted to be used for securing the balcony shielding device to the banister of a conventional balcony;

FIG. 10: in a partial side view, with section sections taken out, illustrates the securement strap shown in FIG. 9 being used for securing a balcony shielding device in accordance with the present invention through a conventional balcony banister, the balcony banister being shown in phantom lines.

DETAILED DESCRIPTION

Figure 1:
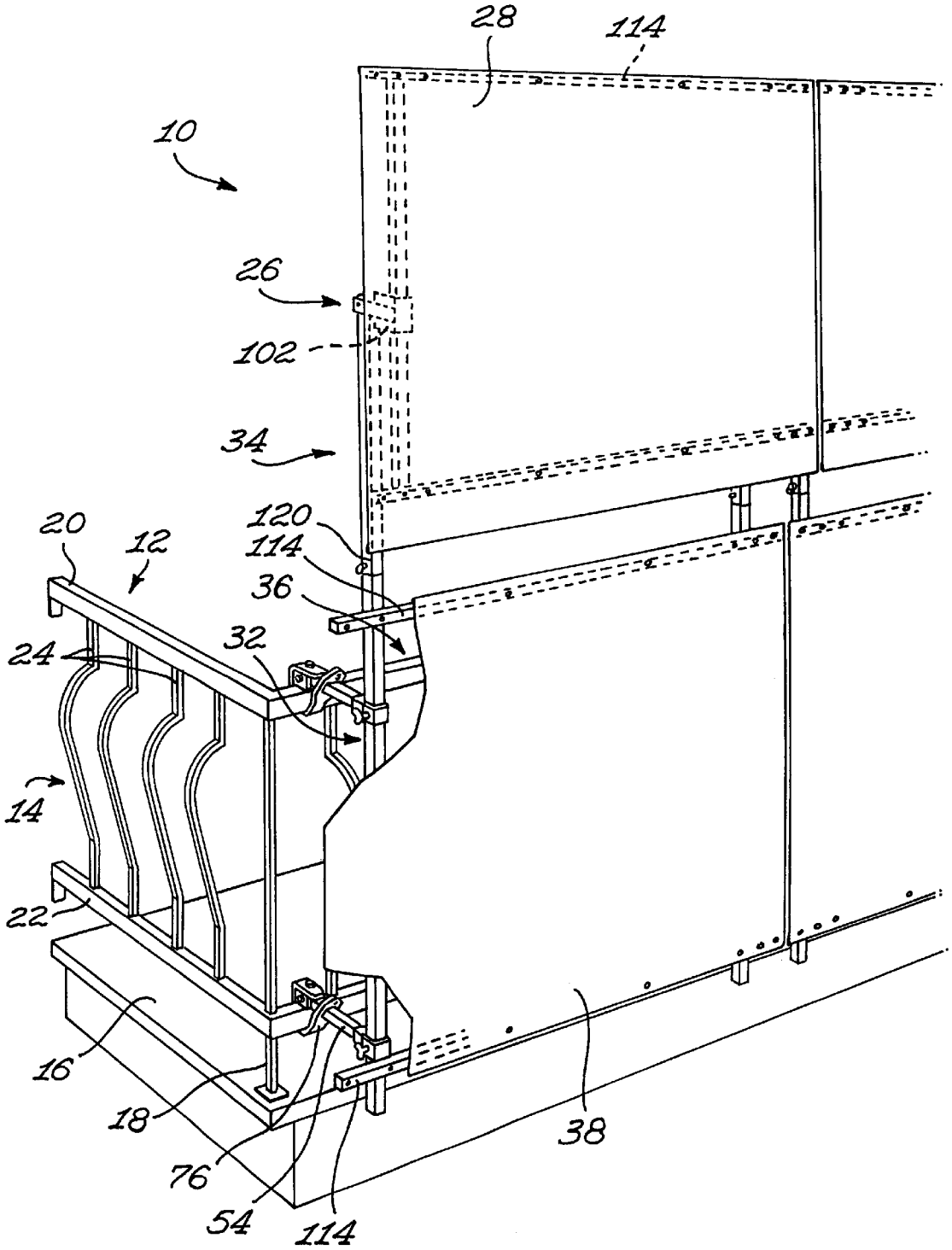
FIG. 1: in a partial perspective view with sections taken out, illustrates a balcony shielding device in accordance with an embodiment of the present invention mounted on a balcony banister.

Referring to FIG. 1, there is shown a balcony shielding device (10) in accordance with an embodiment of the present invention.

The balcony shielding device (10) is shown attached to the banister (12), part of a convention balcony (14). The banister (12) is attached to the balcony floor (16) in a conventional manner, typically using banister attachment posts (18) (only one of which is shown in FIG. 1). The banister (12) includes the handrail (20), a footrail (22) and a set of balusters (24) extending therebetween.

The balcony shielding device (10) includes a first shielding section (26). The first shielding section (26) includes a first shielding screen (28).

The balcony shielding device (10) also includes a mounting means for mounting the balcony shielding device (10) to the balcony (14). The mounting means includes a mounting rod (30) shown in greater details in FIG. 3. The mounting rod (30) defines a rod attachment section (32) and a rod spacing section (34). The rod attachment section (32) is sized so as to extend at least from the footrail (22) to the handrail (20).

Figure 3:
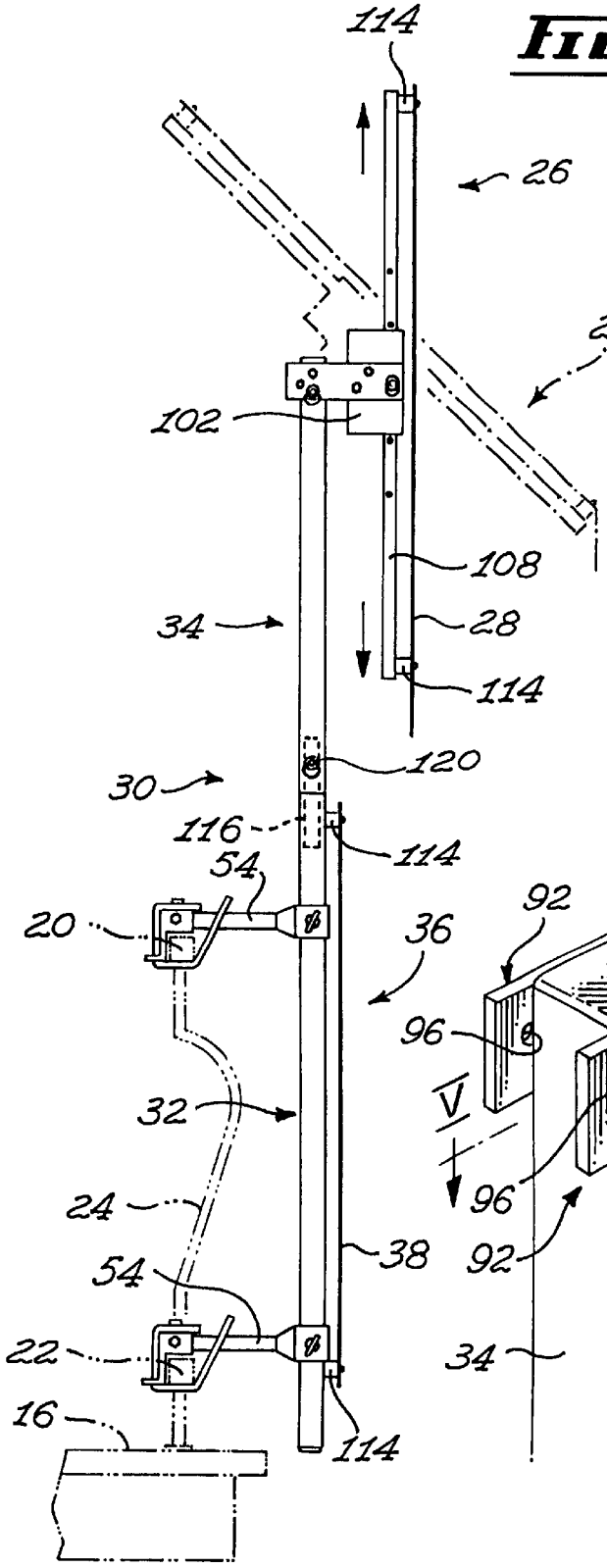
FIG. 3: in a side elevational view, illustrates a balcony shielding device in accordance with an embodiment of the present invention mounted on a balcony banister, the balcony banister being shown in phantom lines. The balcony shielding device being shown with one of its shielding sections pivoted between an initial configuration and a tilted configuration, the tilted configuration being shown in phantom lines.

Typically, the rod attachment section (32) is sized so as to extend from the level of the balcony floor (16) to a level above the handrail (20) as shown in FIGS. 3 and 10.

The rod spacing section (34) extends from the rod attachment section (32) and is adapted to extend upwardly away from the handrail (20).

The mounting means also includes a securement means for securing the rod attachment section (32) to both the handrail (20) and the footrail (22).

In one embodiment of the invention, shown in FIGS. 1 through 3, 7 and 8, the securement means allows the rod attachment section (32) to be secured to both the handrail (20) and the footrail (22) in a spaced relationship relative to the latter so as not to interfere with outwardly protruding balusters (24).

In another embodiment of the invention, shown in FIGS. 9 and 10, the securement means allows the rod attachment section (32) to be secured to both the handrail (20) and the footrail (22) in an abutting relationship relative to the latter without interfering with the relatively rectilinear balusters (24) extending therebetween.

The balcony shielding device (10) further includes a linking means for securely linking the first shielding section (26) to the rod spacing section (34). The balcony shielding device (10) preferably still further includes a second shielding section (36).

The second shielding section (36) includes a second shielding screen (38). The second shielding section (36) is attached to the rod attachment section (32) so as to shield the banister (12).

Referring now more specifically to FIGS. 9 and 10, there is shown in greater details a first embodiment of the securement means.

In its first embodiment, the securement means includes a securement strap (40) defining a pair of opposed strap longitudinal ends (42). The securement strap (40) is provided with a strap-to-rod attachment means positioned adjacent each of the strap longitudinal ends (42) for attaching the strap longitudinal ends (42) to the rod attachment section (32).

The securement strap (40) is also provided with a strap length adjustment means, positioned intermediate the strap longitudinal ends (42), for allowing customization of the length of the strap (40). The securement strap (40) is configured and sized so that when the rod attachment section (32) abuttingly contacts both the handrail (20) and the footrail (22). The securement strap (40) can be tightly wrapped around the banister with one of the strap-to-rod attachment means attached to the rod attachment section (32) adjacent the handrail (20) and the other strap-to-rod attachment means attached to the rod attachment section (32) adjacent the footrail (22), as shown in FIG. 10.

Typically, the strap-to-rod attachment means includes a rod receiving aperture (44) extending through the securement strap (40) adjacent a corresponding strap longitudinal end (42). The rod receiving aperture (44) is configured and sized so as to be substantially fittingly and slidably receive a segment of the rod attachment section (32).

Preferably, the securement strap (40) defines two independent strap segments (46) such as shown in FIG. 9. Each of the strap segments (46) has segment apertures (48) extending therethrough and positioned longitudinally therealong. The strap length adjustment means includes a generally S-shaped hook component (50) selectively attached to one of the segment apertures (48) of both strap segments (46).

Hence, by inserting the hooking segments of the hook component (50) in a predetermined segment apertures (48), the length of the strap (40) may be adjusted so that the securement strap (40) is tightly wrapped around both the handrail (20) and the footrail (22) for securely pulling the rod attachment section (32) against the banister (12).

Typically, the strap segments (46) are made out of a suitable relatively elastomeric material such as an elastomeric resin. The strap segment (46) may be cut to a suitable size by the intended user.

Figure 7:
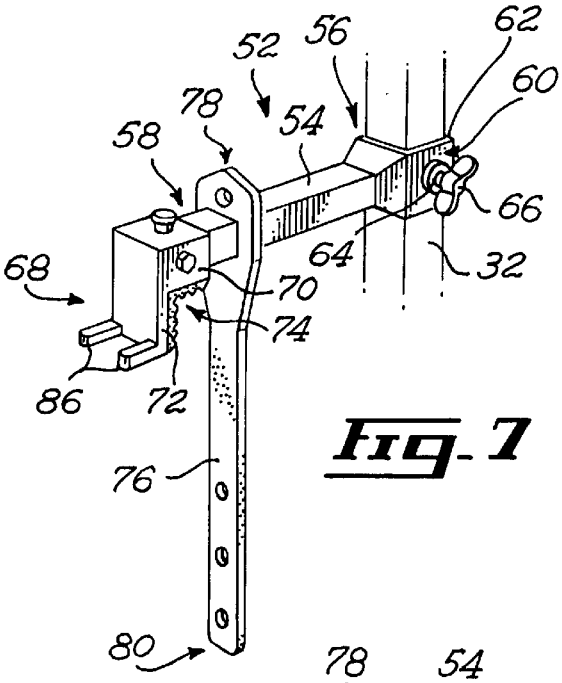
FIG. 7: in a partial perspective view, with sections taken out, illustrates a balcony-to-mounting rod securement component, part of the balcony shielding device, in accordance with the present invention.
Figure 8:
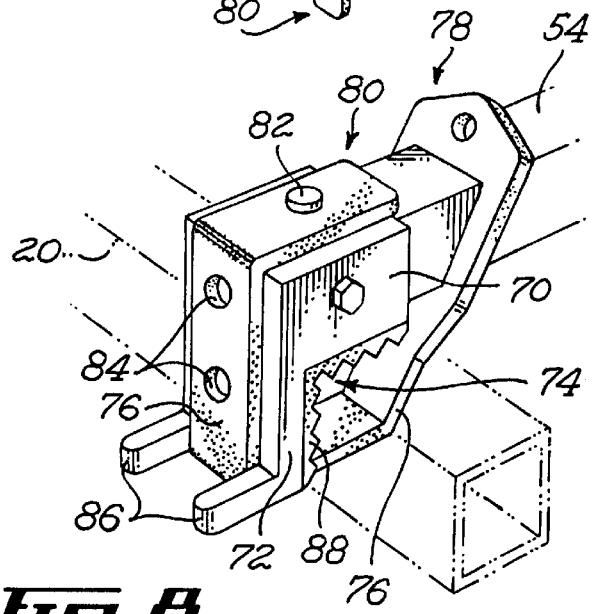
FIG. 8: in a partial perspective view, with sections taken out, illustrates the balcony-to-mounting rod securement component attached to the handrail of a conventional balcony banister, the handrail being shown in phantom lines.

Referring now more specifically to FIGS. 7 and 8, there is shown a second embodiment of the securement means.

In this second embodiment, the securement means includes a pair of balcony-to-mounting rod securement components (52). Each of the balcony-to-mounting rod securement components (52) includes a generally elongated securement component spacing segment (54) defining a spacing segment first longitudinal end (56) and an opposed spacing segment second longitudinal end (58).

Each balcony-to-mounting rod securement component (52) also includes a segment-to-rod attachment means for attaching the securement component spacing segment (54) adjacent the spacing segment first longitudinal end (56) to the rod attachment section (32) so that the securement component spacing segment extends away from the rod attachment section (32).

Each balcony-to-mounting rod securement component (52) further includes a segment-to-balcony attachment means for attaching the securement component spacing segment (54) adjacent the spacing segment longitudinal end (58) to the balcony (14) so that the securement component spacing segment (54) extends away from the balcony (14).

Typically, the segment-to-rod attachment means includes an attachment sleeve (60) defining a sleeve peripheral wall (62). The attachment sleeve (60) is configured and sized for substantially fittingly and slidably receiving at least a section of the rod attachment section (32). The attachment sleeve (60) is provided with a bolt recess (64) extending through the sleeve peripheral wall (62). The segment-to-rod attachment means also includes a locking bolt (66), threadably inserted in the bolt recess (64).

Preferably, the locking bolt (66) is provided with a winged head, so as to facilitate manipulation thereof. The locking bolt (66) defines a bolt tip (not shown) for abuttingly and frictionally contacting the rod attachment section (32) when the latter is inserted into the sleeve (60), as shown in FIG. 7.

The segment-to-balcony attachment means preferably includes a generally L-shaped attachment bracket (68) attached to the securement component spacing segment (54) adjacent the spacing segment second longitudinal end (58).

The attachment bracket (58) defines a bracket first segment (70) extending in a generally parallel relationship with the securement component spacing segment (54) and a bracket second segment (72) extending from a distal end of the bracket first segment (70) in a generally perpendicular relationship relative to the bracket first segment (70). The bracket first and second segments (70), (72), together define a generally L-shaped bracket inner surface (74).

The segment-to-balcony attachment means further includes a biasing means for biasing a segment of the banister (12) against the bracket inner surface (74).

Typically, the biasing means is used for biasing either the handrail (20) or the footrail (22) against the bracket inner surface (74).

Preferably, the biasing means includes a bracket strap (76) defining a bracket strap first longitudinal end (78) and an opposed bracket strap second longitudinal end (80).

The bracket strap first longitudinal end (78) is attached to the securement component spacing section (54) adjacent the spacing segment second longitudinal end (58).

The bracket strap second longitudinal end (80) is provided with a strap-to-bracket attachment means for attaching the bracket strap (76) adjacent the bracket strap second longitudinal end (80) to the bracket first segment (70).

Typically, the strap-to-bracket attachment means includes a bracket locking pin (82) extending from an outer surface of the bracket first segment (70) and corresponding bracket strap apertures (84) formed in the bracket strap (76). One of the strap apertures (84) is adapted to substantially fittingly receive the locking pin (82) for locking the bracket strap (76) in a wrapped configuration shown in FIG. 8 around both the attachment bracket (68) and either a segment of the handrail (20) or the footrail (22) so that either segment of the handrail (20) or the footrail (22) is abuttingly biased against the bracket inner surface (74).

In order to secure the bracket strap (76) in proper alignment with the bracket component (68), the bracket second segment (72) may be provided with a set of guiding tongues (86) extending outwardly from the bracket second segment (72) in a direction leading away from the bracket inner surface (74). The guiding tongues (86) are configured, sized and positioned so as to receive a segment of the bracket strap (76) therebetween.

Furthermore, in order to reduce the risk of slippage between the handrail (20) or footrail (22) and the bracket inner surface 74, the bracket inner surface (74) may optionally be lined with a friction enhancing coating (88). The friction enhancing coating (88) is typically formed out of a generally resilient material such as a layer of elastomeric resin and is preferably provided with a serrated surface.

Figure 4:
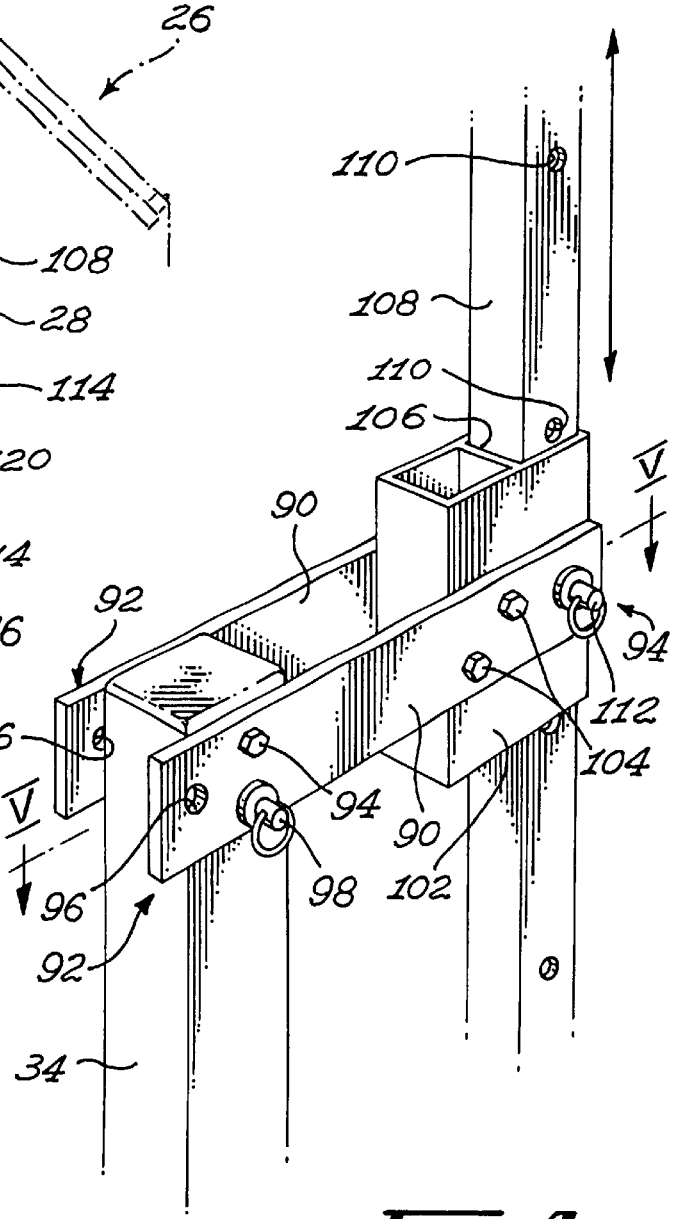
FIG. 4: in a detailed perspective view, with sections taken out, illustrates the connection between a first and a second shielding section, both part of the balcony shielding device shown in FIGS. 2 through 3.
Figure 5:
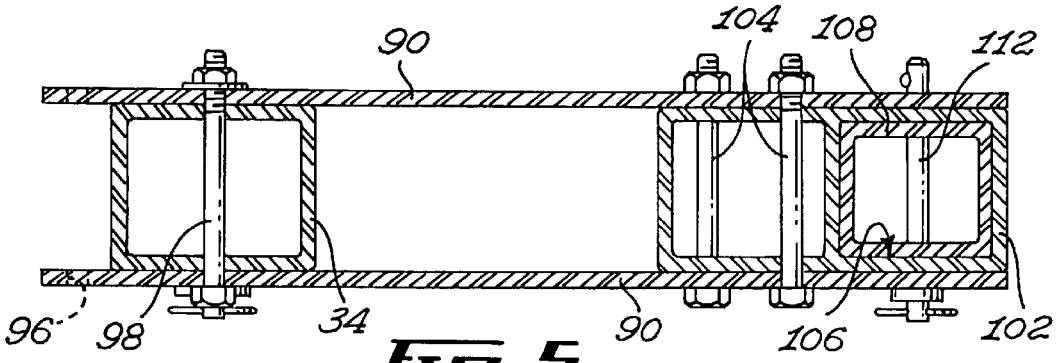
FIG. 5: in a transversal cross sectional view taken along arrows V—V of FIG. 4, illustrates the connection between the first and second shielding sections, both part of the balcony shielding device, shown in FIGS. 1 through 4.

The linking means preferably allows the first shielding section (26) to pivot relative to the mounting rod (30) between a first screen position, shown in full lines in FIG. 3, wherein the first shielding screen (28) is in a generally parallel relationship relative to the rod spacing section (34) and a second screen position, shown in phantom lines in FIG. 3, wherein the first shield screen (28) is in an angled relationship relative to the rod spacing section (34). As shown more specifically in FIGS. 3 through 5, the linking means typically includes, at least one and preferably two, linking plates (90) having a generally elongated configuration and each defining a linking plate first longitudinal end (92) and an opposed linking plate second longitudinal end (94).

Each linking plate (90) is pivotally attached to the rod spacing section (34) adjacent the corresponding plate first longitudinal end (92).

The linking means also includes an angular locking means for locking the linking plates (90) in a predetermined angular relationship relative to the rod spacing section (34). Each linking plate (90) is typically pivotally attached to the rod spacing section (34) using a plate pivot pin (94) extending therethrough. The angular locking means typically includes, at least two, angular locking apertures (96) formed in each linking plate (90).

The angular locking means also includes an angular locking channel (not shown) extending through the rod spacing segment (34) and adapted to be in register with both angular locking apertures (96) depending on the relative angular configuration between the linking plates (90) and the rod spacing segment (34). The angular locking means further includes an angular locking pin (98), adapted to be inserted through both the locking apertures (90) and the locking channel for locking the linking plate (90) in a predetermined angular relationship with the rod spacing segment (34).

The linking means is also preferably provided with a shield height adjustment means for allowing the customization of the distance between the first shield section (26) and the rod attachment section (32). The shield height adjustment means thus allows for height adjustment in a direction generally indicated by arrows "C" in FIGS. 3 and 4. The shield height adjustment means preferably includes a frame mounting sleeve (102) attached to the linking plates (90) by attachment bolts (104) adjacent the plate second longitudinal ends (94). The frame mounting sleeve (102) is provided with at least frame channel (106), configured and sized for slidably and substantially fittingly receiving one of the transversal frame members (108).

The frame mounting sleeve (102) is provided with a frame sleeve releasable locking means for selectively allowing and preventing the elongated frame member (108) to slide within the sleeve channel (106). The frame sleeve releasable locking means typically includes a set of frame member apertures (110), longitudinally spaced along the frame member (108). The frame sleeve releasable locking means also includes a sleeve channel (not shown) extending through the sleeve channel (106).

The frame sleeve releasable locking means further includes a sleeve pin (112) adapted to be slidably inserted through both the frame member apertures (110) and the sleeve channel for releasably locking the frame member (108) in a predetermined position within the sleeve channel (106) so as to allow height customization according to the arrows "C".

Figure 2:
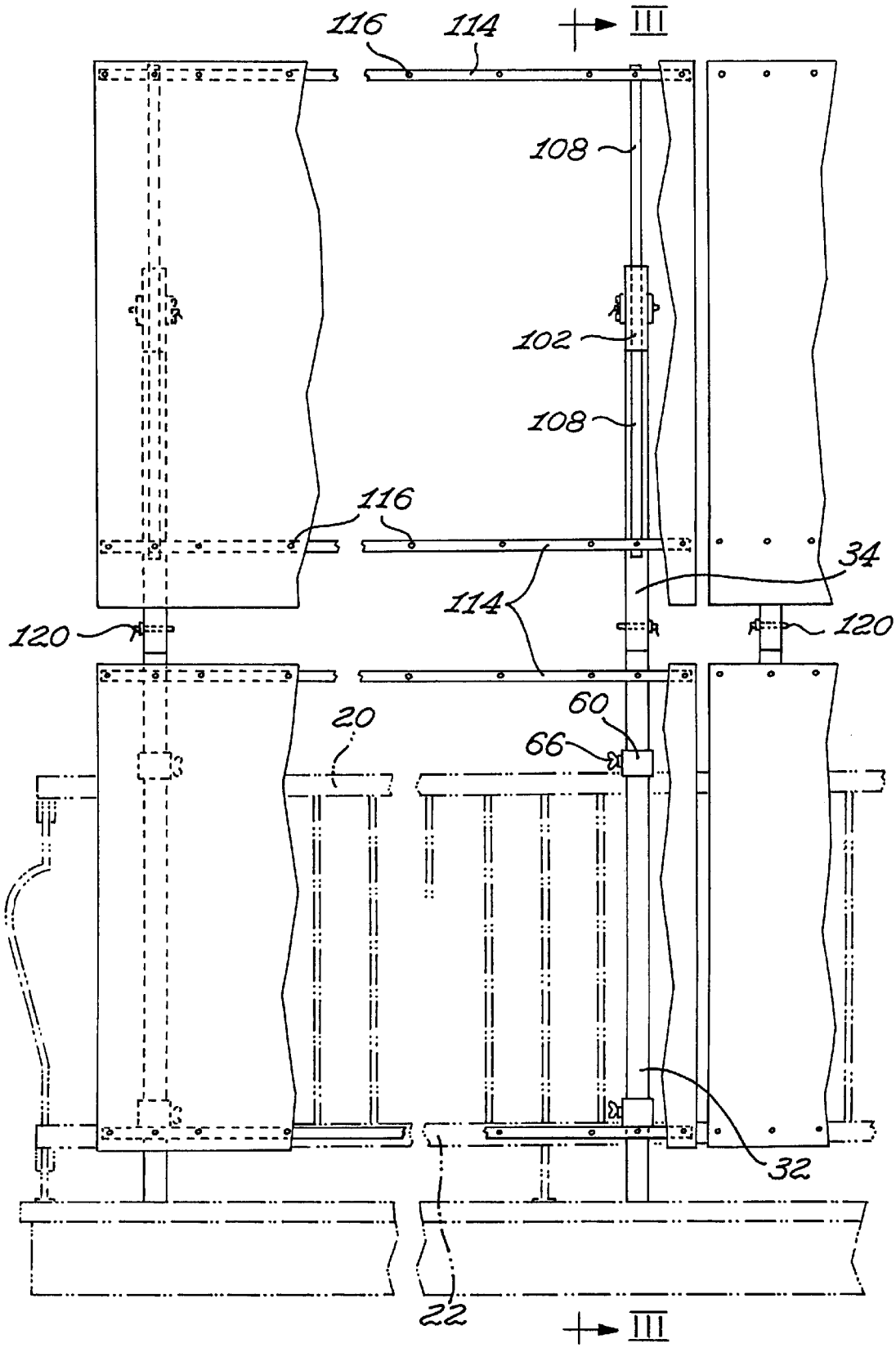
FIG. 2: in a partial elevational view with sections taken out, illustrates a balcony shielding device in accordance with an embodiment of the present invention mounted on a balcony banister, the balcony banister being shown in phantom lines.

As shown more specifically in FIG. 2, both the first shielding screen (28) and the second shielding screen (38), are preferably made out of a panel mounted on a generally rectangular screen frame. The generally rectangular screen frame typically includes, a pair of transversal frame members (108) attached to a pair of longitudinal frame members (114). The first and second screen panels are typically attached to the frame members (108), (114) using conventional fastening means such as rivets (116) or any other suitable fastening means.

It should be understood that although FIGS. 1 and 2 illustrate first and second shielding screens (28), (38) having generally rectangular configurations, the shielding screens (28), (38) and their corresponding frames could have other configurations without departing from the scope of the present invention.

Alternatively, the screen frame could include a single transversal member (108), a triangular frame member arrangement or any other suitable configuration.

Figure 6:
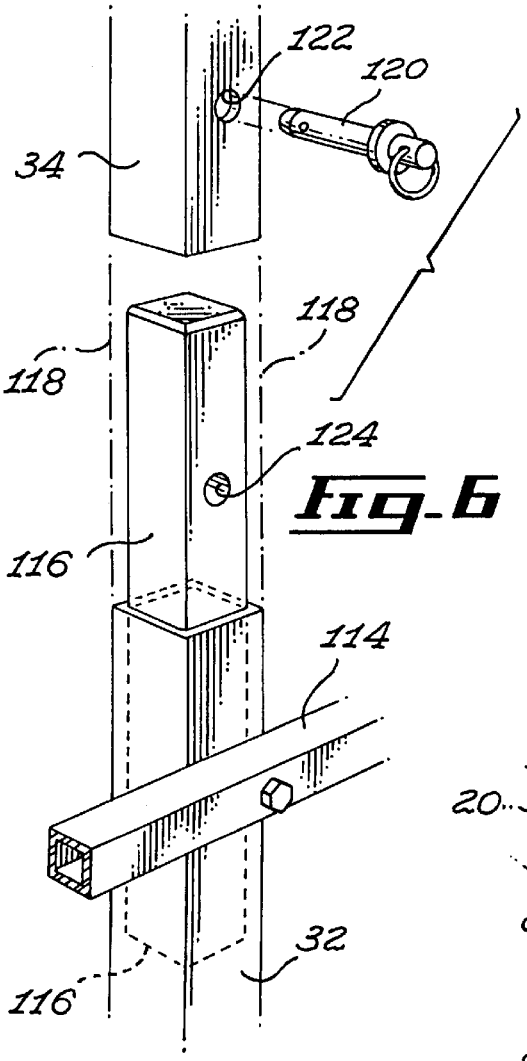
FIG. 6: in a partial perspective view, with sections taken out, illustrates the connection between a rod attachment section and a rod spacing section both part of a mounting rod used with the balcony shielding device shown in FIGS. 1 through 5.

As shown more specifically in FIG. 6, the first and second shielding sections (26), (36) respectively attached to the rod spacing section (34) and to the rod mounting section (32), are preferably releasably attached together so as to allow the balcony shielding device (10) to be collapsible.

In a preferred embodiment of the invention, both the rod spacing section (34) and the rod mounting section (32) are hollow adjacent their mating longitudinal ends so as to allow for the insertion of a rod connecting member (116). The rod connecting member (116) is preferably secured inside the rod mounting section (32) so as to protrude upwardly from the latter.

An adjacent longitudinal end of the rod spacing section (34) can thus be inserted over the rod connecting member (116) as indicated by the broken line (118) in FIG. 6. A rod locking means preferably taking the form of a rod locking pin (120), inserted within corresponding rod locking apertures and channels (122), (124), formed in the rod spacing section (34) and the rod connecting member (116), is used for releasably locking rod spacing section (34) to the rod mounting section (32).

Preferably, each balcony shielding device (10) includes, a pair of mounting rods maintained in spaced apart relationship relative to each other by the longitudinal frame members (116).

Preferably, the mounting rods (30) and the frame members (108), (116) are tubular components made out of a metallic alloy or a suitable polymeric resin.

Preferably, the securement strap (40) and the bracket strap (76) are made out of a generally resilient material such as a suitable elastomeric resin.

Preferably, the first and second shielding screens (28), (38) are made out of a light blocking material such as a sheet of textile or a suitable polymeric material.

Alternatively, the first and second shielding screens (28), (38) may be provided with a textured or marked surface for providing a pleasant visual effect. The first and second shielding screens may optionally be made out of a material allowing for light blocking and for unidirectional viewing. In such instances, the first and second shielding screens are mounted so as to allow the intended user positioned on the balcony to view outside while preventing outside on-lookers to have a view of the balcony.

In use, when the rod attachment section (32) of both mounting rods (30) are secured to both the handrail and the footrail, the first shielding section (26) is securely attached to the balcony (14) above the banister (12). When the balusters are generally rectilinear, the securement strap (40) may be used as the securement means for securing the rod attachment section (32) to both the handrail and the footrail (20), (22).

In situations wherein the balusters are of the ornamental type defining a protruding section, the securement means shown in FIGS. 1, 2, 7 and 8 using the rod securement components (52), are preferably used.

Both securement means secure the rod attachment section (32) to both the handrail (20) and the footrail (22) of the banister (12) so as to provide a sturdy support to the first shielding section (26). This proves to be particularly important since the pressure of the wind on the relatively large surface of the first shielding screen (28) may create a potentially large force tending to dislodge the balcony shielding device (10) from the balcony (14).

The need to prevent dislodgment of the balcony shielding device (10) from the balcony (14) is particularly important since a potential fall of the balcony shielding device (10) may create a relatively important safety hazard.

Once the rod attachment section (32) is secured to both the handrail and the footrail (20), (22) using the appropriate securement means, the height and the angle of the first shielding section (26) may be adjusted using the linking means. Adjustment of the height and the angulation of the first shielding means is possible through a set of thick and ergonomic steps, using the proposed locking pin and aperture arrangements.

The position of the first shielding section (26) can thus be customized depending on the setting in which the balcony shielding device (10) is used.

The position of the first shielding section (26) can also be readily changed, for example when the sun changes position as the day progresses.

The use of the second shielding section (36) allows for lateral and frontal protection against light, wind and vision, providing both shielding and privacy between the handrail (20) and the footrail (22) which are otherwise left open through the banisters (24).

Adjustment of the relative height and angulation between the first and second shielding screens (28), (38) allows an intended user to either totally block and shield the balcony or, alternatively leave a spacing between the lower peripheral edge of the first shielding screen (28) and the upper peripheral edge of the second shielding screen (38) so as to allow vision outside the balcony while still providing selective shielding of the balcony.

The embodiments of the invention in which an exclusive privilege or property is claimed are defined as follows:

1. A device for shielding a balcony, said balcony including a balcony floor and a banister attached to said balcony floor, said banister including a handrail, a foot rail and at least one baluster extending between said handrail and said footrail, said device comprising:

a first shielding section, said first shielding section including a first shielding screen;

a mounting means for mounting said device to said balcony, said mounting means including a mounting rod, said mounting rod defining a rod attachment section and a rod spacing section, said rod attachment section being sized so as to extend at least from said footrail to said handrail when said mounting rod is attached to said banister, said rod spacing section extending from said rod attachment section and being adapted to extend upwardly away from said handrail when said mounting rod is attached to said banister;

a securement means for securing said rod attachment section to both said handrail and said footrail;

a linking means for securely linking said first shielding section to said rod spacing section;

whereby said rod attachment section is adapted to be attached to both said handrail and said footrail while said first shielding section is adapted to be securely attached to said balcony above said banister; said securement means including a securement strap, said securement strap defining a pair of opposed strap longitudinal ends; said securement strap being provided with a strap-to-rod attachment means positioned adjacent each of said strap longitudinal ends for attaching said strap longitudinal ends to said rod attachment section; said securement strap being also provided with a strap length adjustment means positioned intermediate said strap longitudinal ends for allowing customization of the length of said strap; said securement strap being configured and sized so that when said rod attachment section abuttingly contact both said handrail and said footrail, said securement strap can be tightly wrapped around said banister with one of said strap-to-rod attachment means attached to said rod attachment section adjacent said handrail and the other strap-to-rod attachment means attached to said rod attachment section adjacent said footrail;

said securement strap defining two strap segments, each of said strap segments having segment apertures positioned longitudinally therealong, said strap length adjustment means including a hook component selectively attached to one of said segment apertures of both said strap segments.

2. A device for shielding a balcony, said balcony including a balcony floor and a banister attached to said balcony floor, said banister including a handrail, a foot rail and at least one baluster extending between said handrail and said footrail, said device comprising:

a first shielding section, said first shielding section including a first shielding screen;

a mounting means for mounting said device to said balcony, said mounting means including a mounting rod, said mounting rod defining a rod attachment section and a rod spacing section, said rod attachment section being sized so as to extend at least from said footrail to said handrail when said mounting rod is attached to said banister, said rod spacing section extending from said rod attachment section and being adapted to extend upwardly away from said handrail when said mounting rod is attached to said banister;

a securement means for securing said rod attachment section to both said handrail and said footrail;

a linking means for securely linking said first shielding section to said rod spacing section;

whereby said rod attachment section is adapted to be attached to both said handrail and said footrail while said first shielding section is adapted to be securely attached to said balcony above said banister;

said securement means including a pair of balcony-to-mounting rod securement components, each of said balcony-to-mounting rod securement components including a generally elongated securement component spacing segment, said securement component spacing segment defining a spacing segment first longitudinal end and a spacing segment second longitudinal end;

a segment-to-rod attachment means for attaching said securement component spacing segment adjacent said spacing segment first longitudinal end to said rod attachment section so that said securement component spacing segment extends away from said rod attachment section;

a segment-to-balcony attachment means for attaching said securement component spacing segment adjacent said spacing segment second longitudinal end to said balcony so that said securement component spacing segment extends away from said balcony;

whereby one of said segment-to-balcony attachment means is adapted to be attached to said handrail and the other segment-to-balcony attachment means is adapted to be attached to said footrail while said rod attachment section is adapted to be secured to said banister in a spaced relationship relative to the latter.

3. A device as recited in claim 2 wherein said segment-to-rod attachment means includes an attachment sleeve defining a sleeve peripheral wall, said attachment sleeve being configured and sized for substantially fittingly and slidably receiving at least a section of said rod attachment section; said attachment sleeve being provided with a bolt recess extending through said sleeve peripheral wall; said segment-to-rod attachment means also including a locking bolt threadably inserted in said bolt recess, said locking bolt defining a bolt tip for abuttingly and frictionally contacting said rod attachment section when said rod attachment section is inserted into said sleeve.

4. A device as recited in claim 2 wherein said segment-to-balcony attachment means includes a generally "L"-shaped attachment bracket attached to said securement component spacing segment adjacent said spacing segment second longitudinal end, said attachment bracket defining a bracket first segment extending in a generally parallel relationship with said securement component spacing segment and a bracket second segment extending from a distal end of said bracket first segment in a generally perpendicular relationship relative to said bracket first segment, said bracket first and second segment together defining a generally "L"-shaped bracket inner surface;

a biasing means for biasing a segment of said banister against said bracket inner surface whereby said biasing means is adapted to be used for releasably locking a segment of either said handrail or said footrail in abutting contact against said bracket inner surface.

5. A device as recited in claim 4 wherein said biasing means includes a bracket strap, said bracket strap defining a bracket strap first longitudinal end and a bracket strap second longitudinal end, said bracket strap first longitudinal end being attached to said securement component spacing section adjacent said spacing segment second longitudinal end, said bracket strap second longitudinal end being provided with a strap-to-bracket attachment means for attaching said bracket strap adjacent said bracket strap second longitudinal end to said bracket first segment; whereby said strap is configured and sized so as to be wrapped around both said attachment bracket and either a segment of either said handrail or said footrail abutting against said bracket inner surface for releasably locking a segment of either said handrail or said footrail in abutting contact against said bracket inner surface.

6. In combination, a balcony and a device for shielding said balcony, said balcony including a balcony floor and a banister attached to said balcony floor, said banister including a handrail, a foot rail and at least one baluster extending between said handrail and said footrail, said device comprising:

a first shielding section, said first shielding section including a first shielding screen;

a mounting means for mounting said device to said balcony, said mounting means including a mounting rod, said mounting rod defining a rod attachment section and a rod spacing section, said rod attachment section being sized so as to extend at least from said footrail to said handrail when said mounting rod is attached to said banister; said rod spacing section extending from said rod attachment section and being adapted to extend upwardly away from said handrail when said mounting rod is attached to said banister;

a securement means for securing said rod attachment section to both said handrail and said footrail, said securement means being configured so as to be adapted to secure said rod attachment section to both said handrail and said footrail when the latter extend in a direction generally perpendicular relative to said mounting rod;

a linking means for securely linking said first shielding section to said rod spacing section;

whereby said rod attachment section is adapted to be attached to both said handrail and said footrail while said first shielding section is adapted to be securely attached to said balcony above said banister.

7. A combination as recited in claim 6 wherein said securement means includes a securement strap, said securement strap defining a pair of opposed strap longitudinal ends; said securement strap being provided with a strap-to-rod attachment means positioned adjacent each of said strap longitudinal ends for attaching said strap longitudinal ends to said rod attachment section; said securement strap being also provided with a strap length adjustment means positioned intermediate said strap longitudinal ends for allowing customization of the length of said strap; said securement strap being configured and sized so that when said rod attachment section abuttingly contacts both said handrail and said footrail, said securement strap can be tightly wrapped around said banister with one of said strap-to-rod attachment means attached to said rod attachment section adjacent said handrail and the other strap-to-rod attachment means attached to said rod attachment section adjacent said footrail.

8. A combination as recited in claim 7 wherein at least one of said strap-to-rod attachment means includes a rod receiving aperture extending through said securement strap adjacent a corresponding strap longitudinal end, said rod receiving aperture being configured and sized so as to substantially fittingly and slidably receive at least a section of said rod attachment section.

9. A combination as recited in claim 6 wherein said linking means allows said first shield section to pivot relative to said mounting rod about a first shield section pivot axis while remaining attached to said banister; said linking means allowing pivotal movement between a first screen position wherein said first shielding screen is in a generally parallel relationship relative to said rod spacing section and a second screen position wherein said first shield screen is in an angled relationship relative to said rod spacing section.

10. A combination-as recited in claim 9 wherein said linking means includes a linking plate, said linking plate having a generally elongated configuration defining a linking plate first longitudinal end and a linking plate second longitudinal end; said linking plate being pivotally attached to said rod spacing section adjacent said plate first longitudinal end; said linking means also including an angular locking means for locking said linking plate in a predetermined angular relationship relative to said rod spacing section.

11. A combination as recited in claim 6 wherein said linking means is provided with a shield height adjustment means for allowing the customization of the distance between said first shielding section and said rod attachment section.

12. A combination as recited in claim 11 wherein said first shielding screen is mounted on a first screen frame, said first screen frame including at least one elongated frame member, said shield height adjustment means including a frame mounting sleeve, said frame mounting sleeve being attached to said rod spacing section, said frame mounting sleeve being configured and sized for slidably and substantially fittingly receiving said at least one elongated frame member, said frame mounting sleeve being provided with a frame sleeve releasable locking means for selectively allowing and preventing said at least one elongated frame member to slide within said frame mounting sleeve.

13. A combination as recited in claim 6 wherein said linking means allows said first shield section to pivot relative to said mounting rod about a first shield section pivot axis while remaining attached to the banister, the linking means allowing pivotal movement between a first screen position wherein said first shielding screen is in a generally parallel relationship relative to said rod spacing section and a second screen position wherein said second shield screen is in an angled relationship relative to said rod spacing section, said linking means being also provided with a shield height adjustment means for allowing the customization of the distance between said first shielding section and said rod attachment section.

14. A combination as recited in claim 13 wherein said linking means includes a linking plate, said linking plate having a generally elongated configuration defining a linking plate first longitudinal end and a linking plate second longitudinal end; said linking plate being pivotally attached to said rod spacing section adjacent said plate first longitudinal end; said linking means also including an angular locking means for locking said linking plate in a predetermined angular relationship relative to said rod spacing section; said first shielding screen is mounted on a first screen frame, said first screen frame including at least one elongated frame member, said shield height adjustment means including a frame mounting sleeve, said frame mounting sleeve being attached to said linking plate adjacent said linking plate second longitudinal end, said frame mounting sleeve being configured and sized for slidably and substantially fittingly receiving said at least one elongated frame member, said frame mounting sleeve being provided with a frame sleeve releasable locking means for selectively allowing and preventing said at least one elongated frame member to slide within said frame mounting sleeve.

15. A combination as recited in claim 6 wherein said rod spacing section is releasably attached to said rod mounting section.

16. A combination as recited in claim 6 wherein said device further includes a second shielding section, said second shielding section being separate from said first shielding section, said second shielding section including a second shielding screen, said second shielding section being attached to said mounting rod so as to shield said banister.

17. In combination, a balcony and a device for shielding said balcony, said balcony including a balcony floor and a banister attached to said balcony floor, said banister including a handrail, a foot rail and at least one baluster extending between said handrail and said footrail, said device comprising:

a first shielding section, said first shielding section including a first shielding screen;

a second shielding section separate from said first shielding section, said second shielding section including a second shielding screen;

a second section securement means for securing said second shielding section to said banister so that said second shielding screen shields said banister;

a first section securement means for securing said first shielding section to said second shielding section so that when said second shielding screen shields said banister said first shielding screen is positioned above said banister.

18. A combination as recited in claim 17 wherein said second section securement means includes a securement strap, said securement strap defining a pair of opposed strap longitudinal ends; said securement strap being provided with a strap-to-rod attachment means positioned adjacent each of said strap longitudinal ends for attaching said strap longitudinal ends to said rod attachment section; said securement strap being also provided with a strap length adjustment means positioned intermediate said strap longitudinal ends for allowing customization of the length of said strap; said securement strap being configured and sized so that when said rod attachment section abuttingly contacts both said handrail and said footrail, said securement strap can be tightly wrapped around said banister with one of said strap-to-rod attachment means attached to said rod attachment section adjacent said handrail and the other strap-to-rod attachment means attached to said rod attachment section adjacent said footrail.

19. A combination as recited in claim 17 wherein said second section securement means includes a pair of balcony-to-mounting rod securement components, each of said balcony-to-mounting rod securement components including a generally elongated securement component spacing segment, said securement component spacing segment defining a spacing segment first longitudinal end and a spacing segment second longitudinal end;

a segment-to-rod attachment means for attaching said securement component spacing segment adjacent said spacing segment first longitudinal end to said rod attachment section so that said securement component spacing segment extends away from said rod attachment section;

a segment-to-balcony attachment means for attaching said securement component spacing segment adjacent said spacing segment second longitudinal end to said balcony so that said securement component spacing segment extends away from said balcony;

whereby one of said segment-to-balcony attachment means is adapted to be attached to said handrail and the other segment-to-balcony attachment means is adapted to be attached to said footrail while said rod attachment section is adapted to be secured to said banister in a spaced relationship relative to the latter.

20. A combination as recited in claim 17 wherein a linking means for allowing said first shield section to pivot relative to said mounting rod about a first shield section pivot axis between a first screen position wherein said first shielding screen is in a generally parallel relationship relative to said rod spacing section and a second screen position wherein said second shield screen is in an angled relationship relative to said rod spacing section, said linking means being also provided with a shield height adjustment means for allowing the customization of the distance between said first shielding section and said rod attachment section.

* * * * *